United States Patent [19]

Stewart

[11] Patent Number: 4,947,929

[45] Date of Patent: Aug. 14, 1990

[54] APPARATUS FOR CARBON PULP REACTIVATION

[76] Inventor: Peter J. Stewart, 1822 Albany Highway, Maddington, Australia

[21] Appl. No.: 30,714

[22] Filed: Mar. 25, 1987

[30] Foreign Application Priority Data

Mar. 27, 1986 [AU] Australia ..... PH5247

[51] Int. Cl.[5] ..... F26B 3/14

[52] U.S. Cl. ..... 165/66; 165/920; 34/176; 502/56; 423/460; 423/461; 432/85; 432/238

[58] Field of Search ..... 34/176; 432/85, 233, 432/235, 238; 502/56; 423/460, 461; 165/82, 66, 920

[56] References Cited

U.S. PATENT DOCUMENTS

| | | | |
|---|---|---|---|
| 203,933 | 5/1878 | Provost | 34/176 |
| 2,932,904 | 4/1960 | Morehouse | 34/176 |
| 3,524,498 | 7/1970 | Galer | 165/920 |
| 4,353,726 | 10/1982 | Rough, Sr. | 165/920 |
| 4,360,057 | 11/1982 | Koump | 165/82 |
| 4,573,908 | 3/1986 | Ichiyanagi et al. | 432/85 |

FOREIGN PATENT DOCUMENTS

| | | | |
|---|---|---|---|
| 118922 | 5/1943 | Australia | 423/461 |
| 0040699 | 4/1978 | Japan | 423/461 |
| 0129605 | 10/1981 | Japan | 502/56 |
| 0112673 | 7/1982 | Japan | 423/460 |
| 0012203 | 3/1983 | Japan | 423/460 |

*Primary Examiner*—Albert W. Davis, Jr.
*Assistant Examiner*—John K. Ford

[57] ABSTRACT

A heat exchanger for heating fluid particulate material comprising a heating chamber, heating means associated with the heating chamber, a hopper mounted above the heating chamber, a delivery chamber located below the heating chamber, a set of flow passageways extending through the heating chamber between the hopper and delivery chamber, said delivery chamber having an outlet at its lower portion.

13 Claims, 2 Drawing Sheets

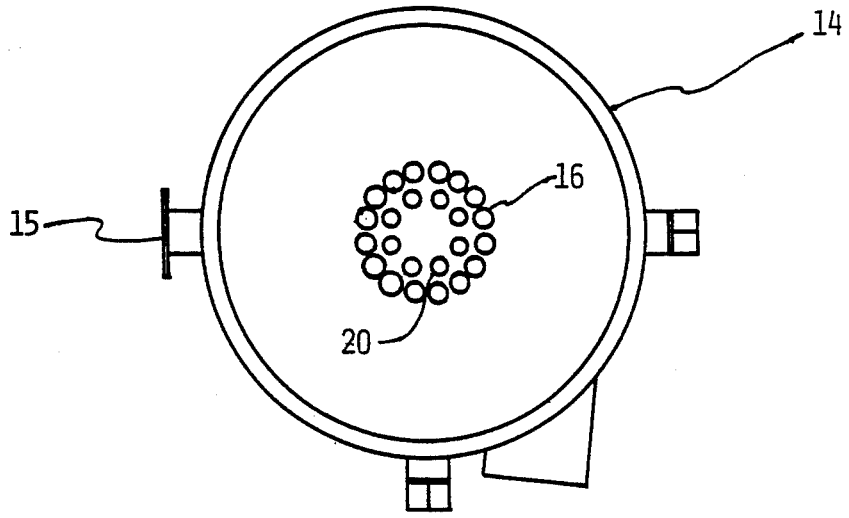
Fig. 2.
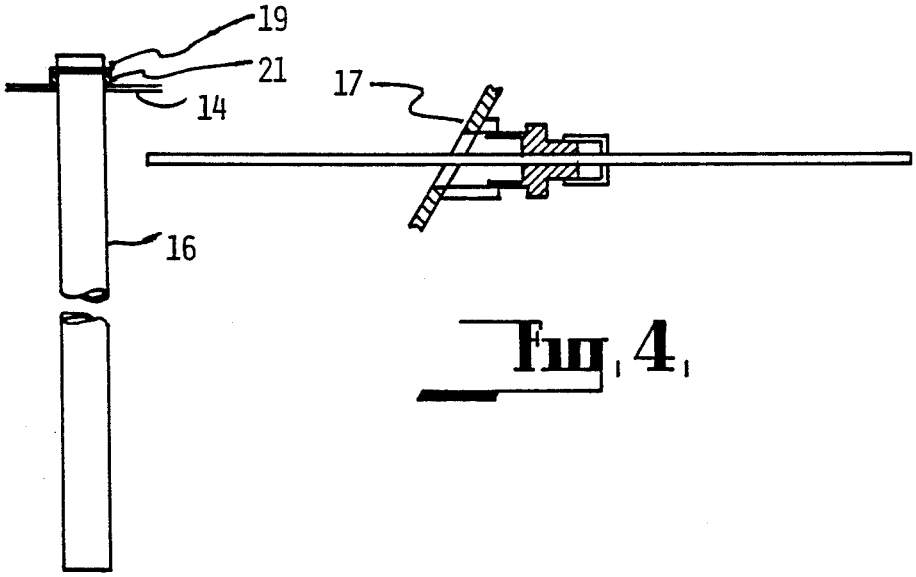
Fig. 4.
Fig. 3.

APPARATUS FOR CARBON PULP REACTIVATION

SUMMARY OF THE INVENTION

This invention relates to a heat exchanger and in particular a heat exchanger which can be used to treat materials for the purpose of calcining, drying, effecting endothermic reactions and the like.

It is an object of the invention to ensure that material while undergoing the desired heating action is substantially isolated from the atmosphere.

In one form the invention resides in a heat exchanger for heating particulate material comprising a heating chamber, heating means associated with the heating chamber, a hopper mounted above the heating chamber, a delivery chamber located below the heating chamber, a set of flow passageways extending through the heating chamber between the hopper and delivery chamber, said delivery chamber having an outlet at its lower portion.

According to a further preferred feature of the invention cooling means are provided between heating chamber and the hopper.

According to a further preferred feature of the invention an injection means is provided at said outlet, said injection means being connected to a source of cooling fluid for providing a metered flow of cooling fluid to the material flowing from the delivery chamber.

According to a further preferred feature of the invention said passageways comprise tubes sealingly received in the lower wall of the hopper.

According to the preferred feature of the invention means are provided for injecting a gaseous fluid into the contents of the hopper.

According to a preferred feature of the previous feature the gaseous fluid is at ambient temperature.

BRIEF DESCRIPTION OF THE DRAWINGS

The invention will be more fully understood in the light of the following description of one specific embodiment. The description is made with reference to the accompanying drawings of which:

FIG. 2 is a plan view of the heat exchanger of FIG. 1 along line 2—2;

FIG. 3 is an illustration of the form of mounting for the heat exchanger tubes in the hopper; and FIG. 4 is an enlarged sectional elevation of the cooling fluid injection means in the outlet of the heat exchanger.

BEST MODE FOR CARRYING OUT THE INVENTION

Figure 1:
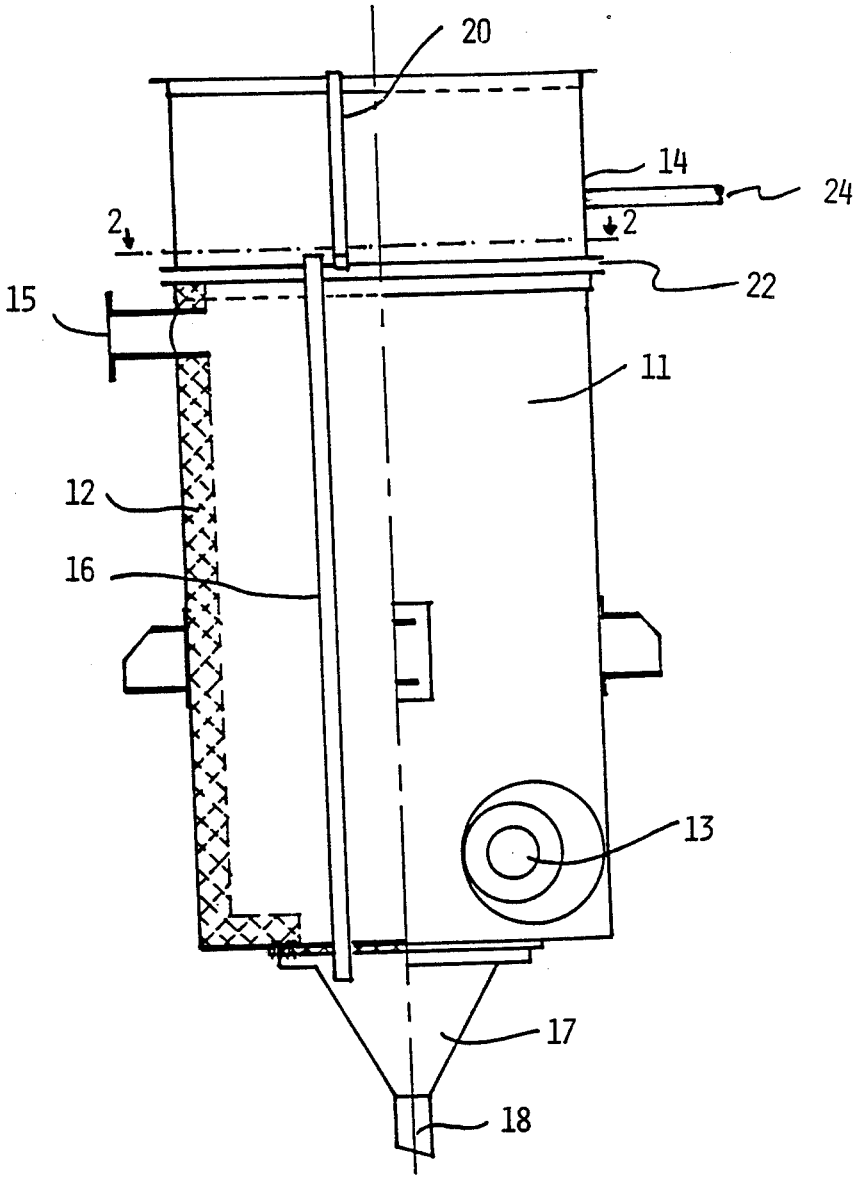
FIG. 1 is a part sectional elevation of a heat exchanger according to the embodiment.

The embodiment of the invention is particularly directed to a heat exchanger for the drying and reactivation of carbon used in the carbon-in-pulp processing of ores. Such carbon is usually delivered to the heat exchanger with a very high water content for reactivation and dewatering. In addition it is necessary that during the reactivation process that the carbon when being heated is isolated from the atmosphere to prevent oxidation.

The heat exchanger of the embodiment comprises a substantially cylindrical heating chamber 11 having insulated side walls 12 and a burner nozzle directed tangentially into the heating chamber through a port 13 provided towards the lower end of the combustion chamber. A flue pipe 15 for the combustion chamber 11 is mounted in the side wall of the heating chamber at the upper end. A cylindrical hopper 14 is supported above the upper end of the heating chamber 11 such that the lower wall of the hopper and the upper end of the combustion chamber are spaced apart. The hopper may be associated with an upper extension (not shown) to increase the capacity of the hopper.

A plurality of tubes 16 (only one is shown in FIG. 1) are mounted between the upper hopper 14 and the combustion chamber 11 to extend between the lower wall of the hopper and the lower face of the heating chamber. The tubes open at their lower end into a delivery chamber 17 which is of substantially inverted conical configuration and which is mounted to the lower end of the heating chamber 11. The lower end of the delivery chamber 17 is formed with an outlet 18 which may be associated with a suitable gate control to control the flow of material from the delivery chamber 17. The mounting of the tube 16 to the lower wall of the hopper 14 is effected by (see FIG. 3) a flange 19 formed on the outer face of the upper end of the tubes 16 which is engaged with the upper face of the lower wall of the hopper 14 to prevent downward movement of the tube 16 past the flange 19. A ceramic washer or seal 2 is located between the flange 19 and the plate of the hopper 14 to effectively seal the opening accommodating the tube 16.

The hopper 14 is provided with a plurality of tubes 20 (only one is shown in FIG. 1) which extend substantially vertically from the space between the heating chamber and hopper to a position clear of the material accommodated within the hopper 14. While the space 22 between the heating chamber and hopper serves in cooling the upper end of the flow passageways the tubes 20 serve in heating the contents of the hopper using the heat extracted from the space.

The outlet 18 is provided with a water injection means (see FIG. 2) comprising a nozzle extending into the chamber 17 and connected to a source of water to provide for a metered supply of water to the outlet 18 whereby the amount of water provided is sufficient to effect cooling of the carbon passing from the outlet 18, to a temperature below that at which oxidation is likely to occur, but it insufficient to retard the fluid flow of the carbon passing from the outlet 18.

As a result of the embodiment of heat exchanger is provided for reactivating carbon whereby the carbon can be heated in isolation from the atmosphere. The injection of a metered supply of cooling water to the outlet of the heat exchanger not only serves in cooling the material flowing from the heat exchanger to a temperature below that at which substantial oxidation can take place but also serves in isolating the interior of the delivery chamber and heat exchanger tubes from the atmosphere. Furthermore the air space created between the combustion chamber 11 and the hopper 14 serves in limiting the heating of the hopper 14 and while the tubes 20 serve in providing convectional air flow through the space and tube 20 to enhance the limited heating of the hopper and its contents.

If desired the hopper may be provided with means for injecting air 24 or any suitable gas of ambient temperature into the contents of the hopper towards the base thereof. The percolation of the air through the contents which are usually heated assists in the removal of water prior to being heated further in the heating chamber.

It should be appreciated that the scope of the present invention need not be limited to the particular scope of the embodiment described above.

I claim:

1. A heat exchanger, for processing a material fluid particulate comprising:

(a) a heating chamber;

(b) heating means for heating said heating chamber;

(c) a hopper mounted above the heating chamber and supported in spaced relation to said heating chamber;

(d) a delivery chamber mounted below said heating chamber, said delivery chamber being provided with an outlet;

(e) injection means for injecting a metered quantity of a cooling liquid into the fluid particulate material prior to its discharge from the outlet at the outlet of said delivery chamber;

(f) a source of cooling liquid connected to said injection means; and (g) a set of flow passageways supported from the hopper and extending from the hopper through the heating chamber to open into the delivery chamber, said flow passageways not being fixed to the heating chamber or delivery chamber.

2. Apparatus as in claim 1 wherein said flow passageways comprise tubes sealingly supported by the base of the hopper.

3. Apparatus as in claim 2 wherein the metered flow of cooling liquid is sufficient to cool the fluid particulate material to a temperature below that at which substantial oxidation occurs.

4. Apparatus as in claim 1 wherein means are provided for injecting a gaseous fluid into the contents of the hopper.

5. Apparatus as in claim 4 wherein the gaseous fluid is air.

6. Apparatus as in claim 1 wherein said fluid particulate material is carbon.

7. A heat exchanger for heating carbon pulp discharged from the carbon-in-pulp processing of mineral ores, said heat exchanger comprising a heating chamber provided with a heating means, a hopper mounted above the heating chamber and supported in spaced relation therefrom, a delivery chamber mounted below the heating chamber, said delivery chamber being provided with an outlet, an injection means at the outlet and connected to a source of cooling liquid to inject a metered quantity of the cooling liquid into the carbon prior to its discharge from the outlet and a set of flow passageways supported from the hopper and extending from the hopper through the heating chamber to open into the delivery chamber, said flow passageways not being fixed to the heating chamber or delivery chamber.

8. A heat exchanger as claimed at claim 7 wherein a plurality of air flow passageways extend through the hopper between the base and the upper end thereof and which open into a space above said heating chamber at their lower ends.

9. A heat exchanger as claimed at claim 7 wherein said flow passageways comprise tubes and seals supported by the base of the hopper.

10. A heat exchanger as claimed at claim 7 wherein the cooling liquid is water.

11. A heat exchanger as claimed at claim 10 wherein the metered flow of cooling water is sufficient to cool the carbon to a temperature below that at which substantial oxidation occurs.

12. A carbon reactivization apparatus for treating carbon pulp discharged from the carbon-in-pulp processing of mineral ores, said apparatus comprising a heating chamber provided with a heating means, a hopper mounted above the heating chamber and supported in spaced relation therefrom, a delivery chamber mounted below the heating chamber, said delivery chamber being provided with an outlet, an injection means at the outlet and connected to a source of cooling liquid to inject a metered quantity of the cooling liquid into the carbon prior to its discharge from the outlet, a set of passageways supported by and suspended from the hopper and extending from the hopper through the heating chamber to open into the delivery chamber, said passageways not being inmoveably fixed to the heating chamber or delivery chamber and a plurality of air flow passageways extending through the hopper between the base and the upper end thereof and opening into space above said heating chamber at their lower ends.

13. A carbon reactivization apparatus for treating carbon pulp discharged from the carbon-in-pulp processing of mineral ores, said apparatus comprising a heating chamber provided with a heating means, a hopper mounted above the heating chamber and supported in spaced relation therefrom, a delivery chamber mounted below the heating chamber, said delivery chamber being provided with an outlet, an injection means at the outlet and connected to a source of cooling liquid to inject a metered quantity of the cooling liquid into the carbon prior to its discharge from the outlet, a set of passageways supported by and suspended from the hopper and extending from the hopper through the heating chamber to open into the delivery chamber, said passageways not being inmoveably fixed to the heating chamber or delivery chamber, a plurality of air flow passageways extending through the hopper between the base and the upper end thereof and opening into a space above said heating chamber at their lower ends, and a means for injection a gaseous fluid into the contents of said hopper.

* * * * *